US011166103B2

(12) United States Patent
Yao et al.

(10) Patent No.: US 11,166,103 B2
(45) Date of Patent: Nov. 2, 2021

(54) PLAYING DEVICE AND PLAYING METHOD BASED ON PLAYING DEVICE

(71) Applicant: HUIZHOU TCL MOBILE COMMUNICATION CO., LTD., Huizhou (CN)

(72) Inventors: Min Yao, Huizhou (CN); Mingliang Liu, Huizhou (CN); Chunxia Yan, Huizhou (CN)

(73) Assignee: HUIZHOU TCL MOBILE COMMUNICATION CO., LTD., Huizhou (CN)

( * ) Notice: Subject to any disclaimer, the term of this patent is extended or adjusted under 35 U.S.C. 154(b) by 0 days.

(21) Appl. No.: 16/651,340

(22) PCT Filed: Sep. 25, 2018

(86) PCT No.: PCT/CN2018/107366
§ 371 (c)(1),
(2) Date: Mar. 26, 2020

(87) PCT Pub. No.: WO2019/062717
PCT Pub. Date: Apr. 4, 2019

(65) Prior Publication Data

US 2020/0275209 A1 Aug. 27, 2020

(30) Foreign Application Priority Data

Sep. 26, 2017 (CN) ..... 201710886867.5

(51) Int. Cl.
*H04R 5/04* (2006.01)
*H04R 1/10* (2006.01)
(Continued)

(52) U.S. Cl.
CPC ..... *H04R 5/04* (2013.01); *H04R 1/1041* (2013.01); *H04R 3/04* (2013.01); *H04R 5/033* (2013.01)

(58) Field of Classification Search
CPC ..... H04R 5/04; H04R 1/1041; H04R 5/033; H04R 3/04
(Continued)

(56) References Cited

U.S. PATENT DOCUMENTS 8,559,650 B2 * 10/2013 Seo ..... H04R 1/10 381/74

FOREIGN PATENT DOCUMENTS

CN 1980488 A 6/2007
CN 102340589 A 2/2012
(Continued)

OTHER PUBLICATIONS

International search report,PCT/CN2018/107366, dated Dec. 29, 2018 (3 pages).
(Continued)

*Primary Examiner* — Vivian C Chin
*Assistant Examiner* — Douglas J Suthers

(57) ABSTRACT

The present disclosure provides a playing device and a playing method based on the playing device. The playing device includes a headphone interface circuit and a speaker circuit. Signal input terminals of the headphone interface circuit and the speaker circuit are directly connected to a sound source output terminal of the playing device. The signal input terminal of the speaker circuit is connected to a first enable signal output terminal when the first enable signal output terminal outputs a matched enable signal, a sound source signal output from the sound source output terminal is played by the speaker circuit. The signal input terminal of the headphone interface circuit is connected to a
(Continued)

second enable signal output terminal. When a headphone is inserted and the second enable signal output terminal outputs a matched enable signal, a sound source signal output from the sound source output terminal is played by the headphone.

8 Claims, 5 Drawing Sheets

(51) Int. Cl.
*H04R 3/04* (2006.01)
*H04R 5/033* (2006.01)

(58) Field of Classification Search
USPC ..... 381/74, 123, 300
See application file for complete search history.

(56) References Cited

FOREIGN PATENT DOCUMENTS

| | | | |
|---|---|---|---|
| CN | 102651834 | A | 8/2012 |
| CN | 203289630 | U | 11/2013 |
| CN | 203407000 | U | 1/2014 |
| CN | 104561515 | A | 4/2015 |
| CN | 106454644 | A | 2/2017 |
| CN | 106792358 | A | 5/2017 |
| CN | 107864422 | A | 3/2018 |
| EP | 2129166 | A2 | 12/2009 |
| JP | H0865070 | A | 3/1996 |

OTHER PUBLICATIONS

First Office Action from China patent office in a counterpart Chinese patent Application 201710886867.5, dated Mar. 28, 2019 (25 pages).

* cited by examiner

PLAYING DEVICE AND PLAYING METHOD BASED ON PLAYING DEVICE

CROSS-REFERENCE TO RELATED APPLICATIONS

The present application is a 35 U.S.C. § 371 National Phase conversion of International (PCT) Patent Application No. PCT/CN2018/107366 filed on Sep. 25, 2018, which claims foreign priority to Chinese Patent Application No. 201710886867.5, filed on Sep. 26, 2017 in the China National Intellectual Property Administration, the entire contents of which are hereby incorporated by reference.

FIELD

The described embodiments relate to an audio playing technology, and more particularly, to a playing device and a playing method based on the playing device.

BACKGROUND

As various playing devices such as mobile phones and tablets are more and more widely used in all aspects of our lives, people have higher and higher requirements for audio, and people also hope that application scenarios of audio playing will become more and more abundant.

Currently, during playing a file, when an external audio device is connected to a playing device, an output audio signal can be heard only through the external audio device. In this case, a built-in speaker circuit of the playing device has no sound, i.e., the playing device cannot drive the built-in speaker and the external audio device at the same time. The playing device cannot support the external audio device and the playing device to output files at the same time, and it affects the user experience.

SUMMARY

A technical problem mainly solved by the present disclosure is to provide a playing device and a playing method based on the playing device, which may realize a function of simultaneously driving its speaker and external audio device, and the user experience may be improved.

In order to achieve the above-mentioned purpose, the present disclosure provides a playing device including a headphone interface circuit and a speaker circuit; wherein a signal input terminal of the headphone interface circuit and a signal input terminal of the speaker circuit are directly connected to a sound source output terminal of the playing device; the signal input terminal of the speaker circuit is further connected to a first enable signal output terminal of the playing device; and when the first enable signal output terminal outputs a matched enable signal, a sound source signal output from the sound source output terminal is played by the speaker circuit; the signal input terminal of the headphone interface circuit is further connected to a second enable signal output terminal of the playing device; and when a headphone is inserted and the second enable signal output terminal outputs a matched enable signal, a sound source signal output from the sound source output terminal is played by the headphone; the headphone interface circuit includes a first switching circuit, a second switching circuit, and a control circuit; an input terminal of the first switching circuit is connected to a left channel output terminal of the sound source output terminal; and an input terminal of the second switching circuit is connected to a right channel output terminal of the sound source output terminal; an output terminal of the first switching circuit is connected to a left channel signal output terminal of the headphone interface circuit; an output terminal of the second switching circuit is connected to a right channel signal output terminal of the headphone interface circuit; a control terminal of the first switching circuit and a control terminal of the second switching circuit are connected to the control circuit; the control circuit is further connected to the second enable signal output terminal; and when a headphone is inserted and the second enable signal output terminal outputs a matched enable signal, the control circuit controls the first switching circuit and the second switching circuit to turned on, and a sound source signal output from the sound source output terminal is played by the headphone; the first switching circuit includes one or more switching devices connected in series; the second switching circuit includes one or more switching devices connected in series; the headphone interface circuit further includes a first resistor and a second resistor; the first resistor is connected in parallel with the first switching circuit; and the second resistor is connected in parallel with the second switching circuit.

In order to achieve the above-mentioned purpose, the present disclosure provides a playing device including a headphone interface circuit and a speaker circuit; wherein a signal input terminal of the headphone interface circuit and a signal input terminal of the speaker circuit are directly connected to a sound source output terminal of the playing device; the signal input terminal of the speaker circuit is further connected to a first enable signal output terminal of the playing device; and when the first enable signal output terminal outputs a matched enable signal, a sound source signal output from the sound source output terminal is played by the speaker circuit; the signal input terminal of the headphone interface circuit is further connected to a second enable signal output terminal of the playing device; and when a headphone is inserted and the second enable signal output terminal outputs a matched enable signal, a sound source signal output from the sound source output terminal is played by the headphone.

In order to achieve the above-mentioned purpose, the present disclosure provides a playing method based on a playing device, wherein the playing device includes a headphone interface circuit and a speaker circuit; a signal input terminal of the headphone interface circuit and a signal input terminal of the speaker circuit are directly connected to a sound source output terminal of the playing device; the signal input terminal of the speaker circuit is further connected to a first enable signal output terminal of the playing device; and the signal input terminal of the headphone interface circuit is further connected to a second enable signal output terminal of the playing device; the playing method includes: detecting by the playing device, whether an enable signal output from the first enable signal terminal matches an enable signal of the speaker circuit; when the enable signal output from the first enable signal terminal matches the enable signal of the speaker circuit, starting the speaker circuit to play a sound source signal output from the sound source output terminal; detecting whether a headphone is inserted into the headphone interface circuit; when the headphone is inserted into the headphone interface circuit, detecting whether an enable signal output from the second enable signal terminal matches an enable signal of the headphone interface circuit; when the enable signal output from the second enable signal terminal matches the enable signal of the headphone interface circuit, playing a sound source signal output from the sound source output terminal, by the headphone and the speaker circuit simultaneously.

Beneficial effects of the present disclosure are that, the present disclosure provides a playing device including a headphone interface circuit and a speaker circuit; wherein a signal input terminal of the headphone interface circuit and a signal input terminal of the speaker circuit are directly connected to a sound source output terminal of the playing device; the signal input terminal of the speaker circuit is further connected to a first enable signal output terminal of the playing device; and when the first enable signal output terminal outputs a matched enable signal, a sound source signal output from the sound source output terminal is played by the speaker circuit; the signal input terminal of the headphone interface circuit is further connected to a second enable signal output terminal of the playing device; and when a headphone is inserted and the second enable signal output terminal outputs a matched enable signal, a sound source signal output from the sound source output terminal is played by the headphone. Therefore, a function that a speaker and an external audio device of a playing device can be driven simultaneously, may be realized, and the user experience may be improved.

DETAILED DESCRIPTION

The present disclosure provides a playing device and a playing method based on the playing device. In order to make the objectives, the technical solutions, and the technical effects of the present disclosure clearer, the following further describes the present disclosure in detail. It should be understood that, the specific implementation regulations described here are only used in explaining the present disclosure, it is not intended to limit the present disclosure.

Figure 1:
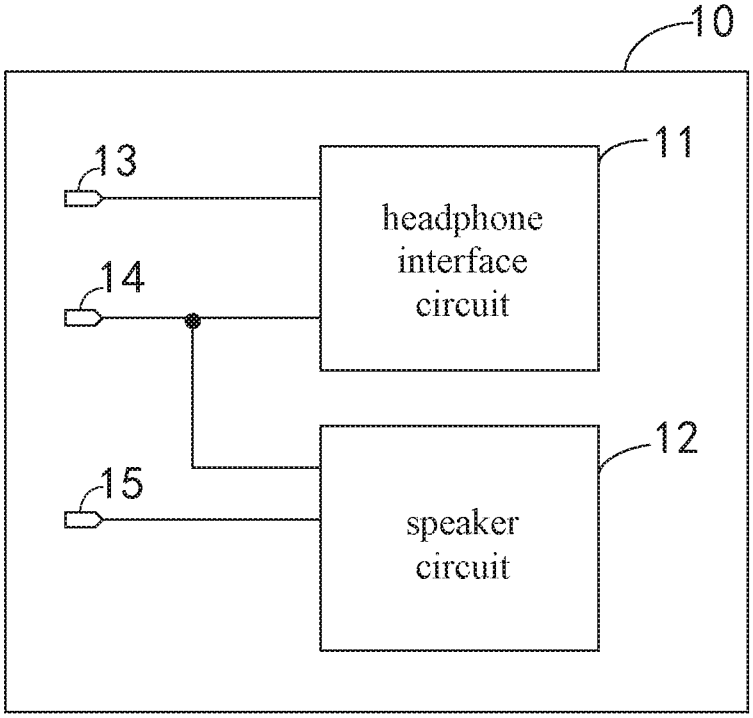
FIG. 1 is a structure illustration of a playing device in accordance with an embodiment in the present disclosure.

Referring to FIG. 1, FIG. 1 is a structure illustration of a playing device in accordance with an embodiment in the present disclosure. In this embodiment, the playing device 10 may include a headphone interface circuit 11 and a speaker circuit 12.

The playing device 10 may include a mobile phone, a tablet computer, and a smart TV, which are not specifically limited herein.

In this embodiment, a signal input terminal of the headphone interface circuit 11 and a signal input terminal of the speaker circuit 12 may be directly connected to a sound source output terminal 14 of the playing device, respectively.

The signal input terminal of the speaker circuit 12 may be further connected to a first enable signal output terminal 15 of the playing device 10. When speaker circuit 12 outputs a matched enable signal at the first enable signal output terminal 15, a sound source signal output from the sound source output terminal 14 may be played.

The signal input terminal of the headphone interface circuit 11 may be further connected to a second enable signal output terminal 13 of the playing device 10. When a headphone is inserted and the second enable signal output terminal 13 outputs a matched enable signal, a sound source signal output from the sound source output terminal 14 may be played by the headphone.

Figure 2:
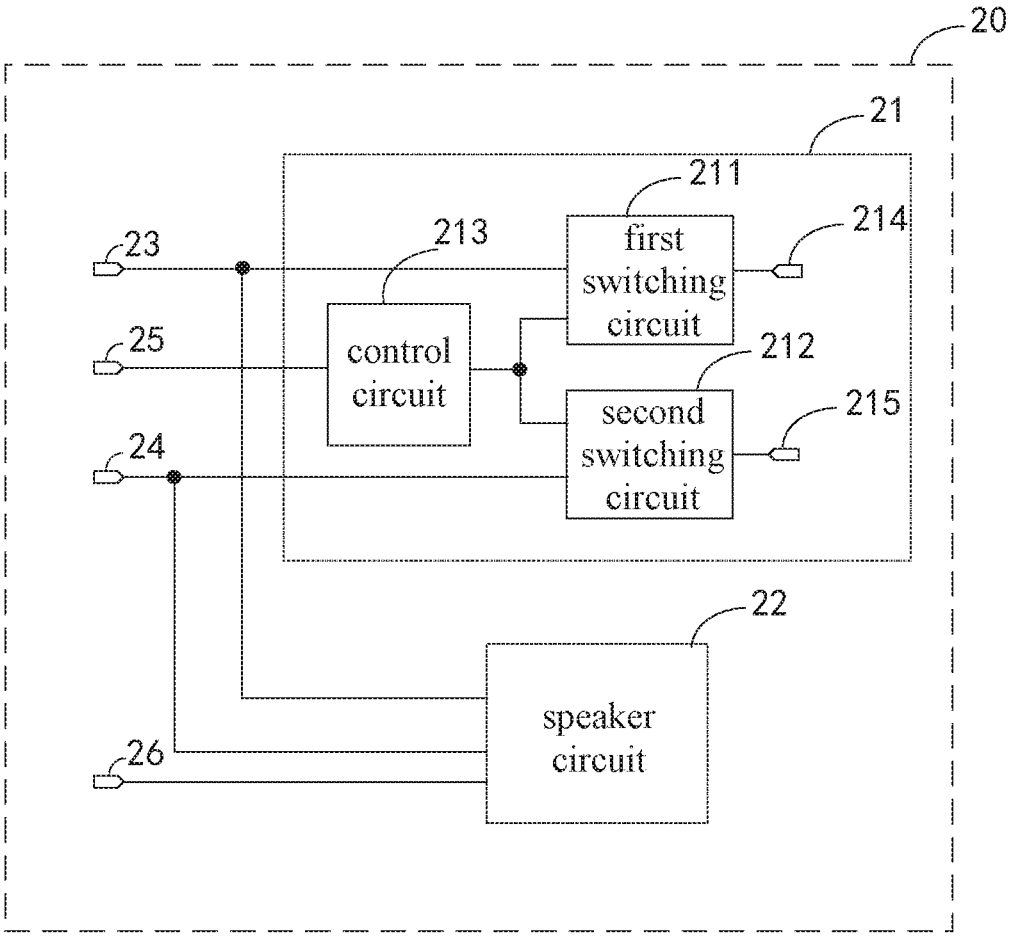
FIG. 2 is a structure illustration of a playing device in accordance with another embodiment in the present disclosure.

Further, FIG. 2 is a structure illustration of a playing device in accordance with another embodiment in the present disclosure.

Referring to FIG. 2, the headphone interface circuit 21 of the playing device 10 may include a first switching circuit 211, a second switching circuit 212, and a control circuit 213.

An input terminal of the first switching circuit 211 may be connected to a left channel output terminal 23 of the sound source output terminal. An input terminal of the second switching circuit 212 may be connected to a right channel output terminal 24 of the sound source output terminal. An output terminal of the first switching circuit 211 may be connected to a left channel signal output terminal 214 of the headphone interface circuit 21. An output terminal of the second switching circuit 212 may be connected to a right channel signal output terminal 215 of the headphone interface circuit 21.

Further, the left channel output terminal 23 of the sound source output terminal and the right channel output terminal 24 of the sound source output terminal may be also connected to the speaker circuit 22. The first enable signal output terminal 26 may be connected to the speaker circuit 22, so that when the first enable signal output terminal 26 outputs a matched enable signal, a sound source signal output from the sound source output terminal may be played by the speaker circuit 22.

In addition, the first switching circuit 211 and the second switching circuit 212 may include one or more switching devices connected in series. The switching devices may include a metal oxide semiconductor (MOS) transistor and a bipolar junction transistor. By controlling the switching devices in a turn-on state or a turn-off state, a branch corresponding to the turn-on state or the turn-off may be selected.

A control terminal of the first switching circuit 211 and a control terminal of the second switching circuit 212 may be connected to the control circuit 213. The control circuit 213 may be further connected to the second enable signal output terminal 25. When a headphone is inserted and the second enable signal output terminal 25 outputs a matched enable signal, the control circuit 213 may control the first switching circuit 211 and the second switching circuit 212 to turn on, and a sound source signal output from the sound source output terminal may be played by the headphone;

In this embodiment, the speaker circuit 22 may play a sound source signal by driving a speaker. Generally, a speaker adopted by the playing device 20 may have impedance which is 8 ohms, and it may require a specific power of a signal to drive the speaker. In order to ensure that the sound source signal may be played normally by a speaker of the playing device 20, a power amplifier may be required to be added. An input terminal of a power amplifier and the sound source output terminal may be connected to the first enable signal output terminal 26. An output terminal of the power amplifier may be connected to a speaker in the speaker circuit. After the power amplifier receives an enable signal for turning the power amplifier on, the sound source signal output from the sound source output terminal may be amplified by corresponding multiples, so that the amplified sound source signal may drive the speaker to play sound normally.

Therefore, based on the above-mentioned embodiments, when the headphone interface circuit 21 and the speaker circuit 22 work simultaneously, and sound levels of the sound source signals played by the headphone interface circuit 21 and the speaker circuit 22 are inconsistent, it affects the user's hearing experience. In order to ensure that there is not much difference between the sound levels of the sound source signals played by the headphone interface circuit 21 and the speaker circuit 22, in an embodiment, the headphone interface circuit 21 may further include a first resistor and a second resistor. The first resistor may be connected in parallel with the first switching circuit 211. The second resistor may be connected in parallel with the second switching circuit 212. A resistance value of the first resistor and a resistance value of the second resistor may be specific values, so that two sets of sound source signal transmission branch may be formed in the headphone interface circuit 21.

When the first switching circuit 211 and the second switching circuit 212 are turned on, a transmission branch formed by the first switching circuit 211 and the second switching circuit 212 may have lower impedance, so that the sound source signal may output the sound source signal through the transmission branch.

When the first switching circuit 211 and the second switching circuit 212 are turned off, a signal may be transmitted through a transmission branch formed by the first resistor and the second resistor. The resistance value of the first resistor and the resistance value of the second resistor may be specific values, which may ensure that the sound level of the sound source signal output by the headphone interface circuit 21 and the sound level of the sound source signal output by the speaker circuit 22, have a smaller difference, and may respond simultaneously to a volume up or a volume down operation.

In this embodiment, the resistance value of the first resistor and the resistance value of the second resistor may be determined by the following formula (1).

$$R = \left(\frac{V_{rms1}}{V_{rms2}} - 1\right) * R_2 \tag{1}$$

In the formula (1), R may be the resistance value of the first resistor or the resistance value of the second resistor. $V_{rms1}$ may be an effective voltage value of the sound source signal received by the power amplifier. $V_{rms2}$ may be an effective voltage value of the sound source signal through the transmission branch formed by the first resistor and the second resistor, received by a headphone. $R_2$ may be an impedance value of the headphone.

Figure 3:
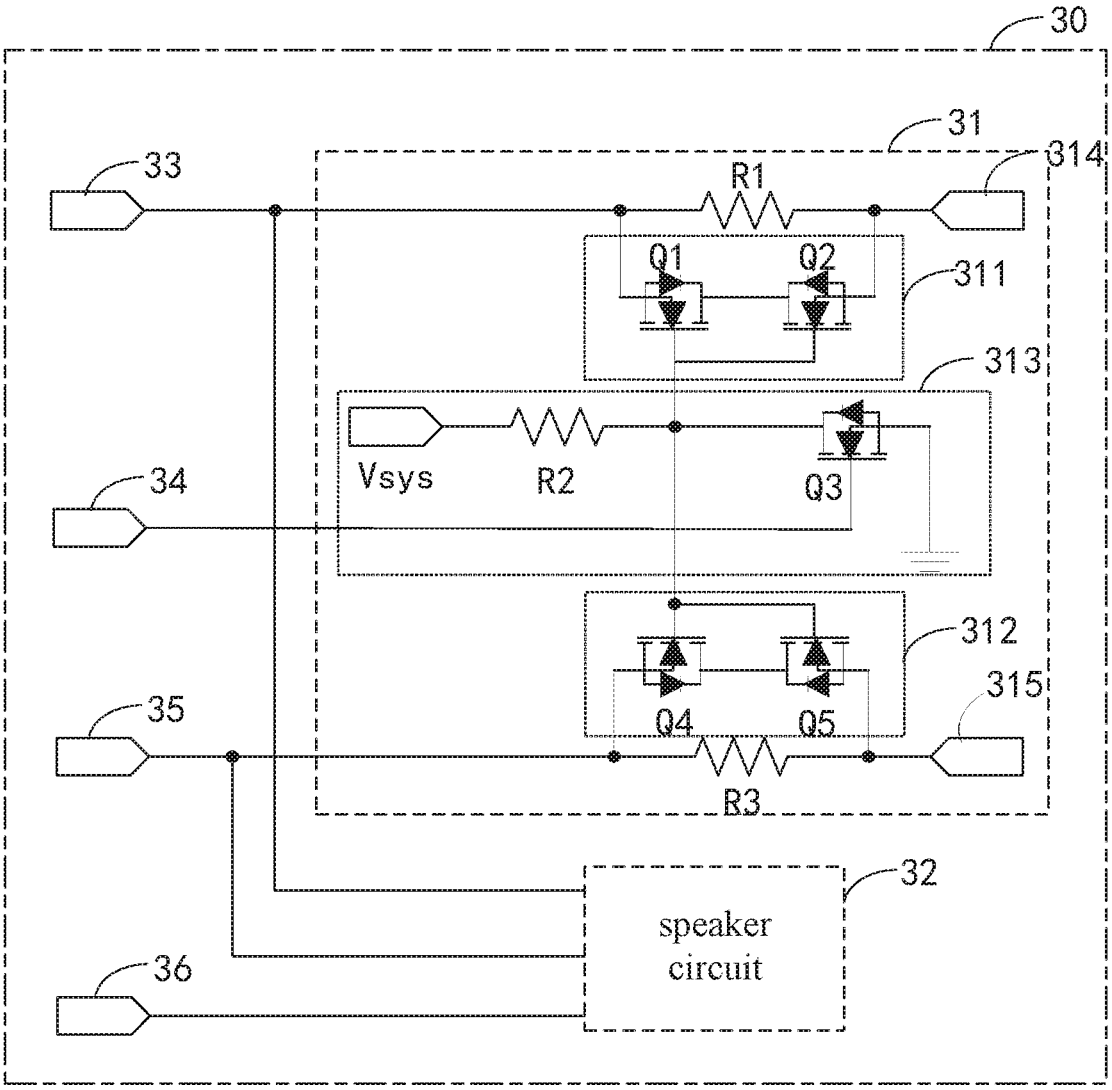
FIG. 3 is a circuit illustration of a playing device in accordance with an embodiment in the present disclosure.

In order to clearly explain a working principle of the playing device in any one of the above-mentioned embodiments, the first switching circuit and the second switching circuit included in the switching devices are exemplified as MOS transistors. Referring to FIG. 3, FIG. 3 is a circuit illustration of a playing device in accordance with an embodiment in the present disclosure.

Referring to FIG. 3, a headphone interface circuit 31 of a playing device 30 may include a first switching circuit 311, a second switching circuit 312, and a control circuit 313. The control circuit 313 may include a third MOS transistor Q3. A gate of the third MOS transistor Q3 may be connected to a second enable signal output terminal 34. A power supply $V_{sys}$ may be connected to a drain of the third MOS transistor Q3 through a resistor R2. A source of the third MOS transistor Q3 may be grounded.

The first switching circuit 311 may include a first MOS transistor Q1 and a second MOS transistor Q2. A gate of the first MOS transistor Q1 and a gate of the second MOS transistor Q2 may be connected to the drain of the third MOS transistor Q3. A source of the first MOS transistor Q1 may be connected to a left channel output terminal 33 of a sound source output terminal. A drain of the first MOS transistor Q1 may be connected to a drain of the second MOS transistor Q2. A source of the second. MOS transistor Q2 may be connected a left channel signal output terminal 314 of the headphone interface circuit 31.

The second switching circuit 312 may include a fourth MOS transistor Q4 and a fifth MOS transistor Q5. A gate of the fourth MOS transistor Q4 and a gate of the fifth MOS transistor Q5 may be connected to the drain of the third MOS transistor Q3. A source of the fourth MOS transistor Q4 may be connected to a right channel output terminal 35 of the sound source output terminal. A drain of the fourth MOS transistor Q4 may be connected to a drain of the fifth MOS transistor Q5. A source of the fifth MOS transistor Q5 may be connected a right channel signal output terminal 315 of the headphone interface circuit 31.

The first switching circuit 311 may be further connected in parallel with a first resistor R1. The second switching circuit 312 may be further connected in parallel with a second resistor R3. A resistance value of the first resistor R1 and a resistance value of the second resistor R2 may be specific values determined in the above-mentioned Formula (1).

Further, a signal input terminal of the speaker circuit 32 may be connected to the left channel output terminal 33 of the sound source output terminal, the right channel output terminal 35 of the sound source output terminal, and a first enable signal output terminal 36.

The working principle of the playing device according to this embodiment will be specifically described below with reference to FIG. 3.

For explanation, a power amplifier in the speaker circuit 32 that is enabled at a high level, is taken as an example. When the first enable signal output terminal 36 outputs a high level, the power amplifier may be turned on, so that the speaker circuit 32 may play the sound source signal output from the sound source output terminal, i.e., a speaker mode of the playing device 30 may be started.

When the second enable signal output terminal 34 outputs a low level, the third MOS transistor Q3 may be turned off, and the first MOS transistor Q1, the second MOS transistor Q2, the fourth MOS transistor Q4, and the fifth MOS transistor Q5 may be turned on. The sound source signal may pass through a path formed by the first switching circuit 311 and the second switching circuit 312, i.e., the function that the speaker circuit 32 and the headphone interface circuit 31 simultaneously output a sound source signal, may be realized.

When the second enable signal output terminal 34 outputs a high level, the third MOS transistor Q3 may be turned on, and the first MOS transistor Q1 and the second MOS transistor Q2 may be turned off, so that a branch where the first resistor R1 is located may be turned on, and the left channel signal of the sound source signal may be transmitted to an external audio receiving device through the branch where the first resistor R1 is located. With the above-mentioned analysis, the fourth MOS transistor Q4 and the fifth MOS transistor Q5 may be also turned off, so that a branch where the second resistor R3 is located is turned on, and the right channel signal of the sound source signal may be transmitted to the external audio receiving device through the branch where the second resistor R3 is located. Therefore, when a headphone mode of the playing device 30 is turned on, a difference between a sound level of the sound source signal received by the headphone through the branch and the sound level output by the speaker circuit 32 may be smaller, which may improve the user hearing experience.

Different from the related art, the present disclosure provides the playing device including the headphone interface circuit, and the speaker circuit; wherein the signal input terminal of the headphone interface circuit and the signal input terminal of the speaker circuit are directly connected to the sound source output terminal of the playing device; the signal input terminal of the speaker circuit is further connected to a first enable signal output terminal of the playing device; and when the first enable signal output terminal outputs the matched enable signal, the sound source signal output from the sound source output terminal is played by the speaker circuit; the signal input terminal of the headphone interface circuit is further connected to the second enable signal output terminal of the playing device; and when the headphone is inserted and the second enable signal output terminal outputs the matched enable signal, the sound source signal output from the sound source output terminal is played by the headphone. Therefore, the function that the speaker and the external audio device of the playing device can be driven simultaneously, may be realized, and the user experience may be improved.

In an actual use process that the playing device is in the headphone mode and the second enable signal output terminal outputs a high level, when an amplitude of the sound source signal is larger, an effective voltage value of the sound source signal may be larger than an on-voltage of the MOS transistor, so that the MOS transistor in the negative voltage signal may be turned on, which affects transmission of the sound source signal. Thus, it is necessary to increase capacitance and resistance in the first switching circuit and the second switching to improve the above-mentioned situation.

Figure 4:
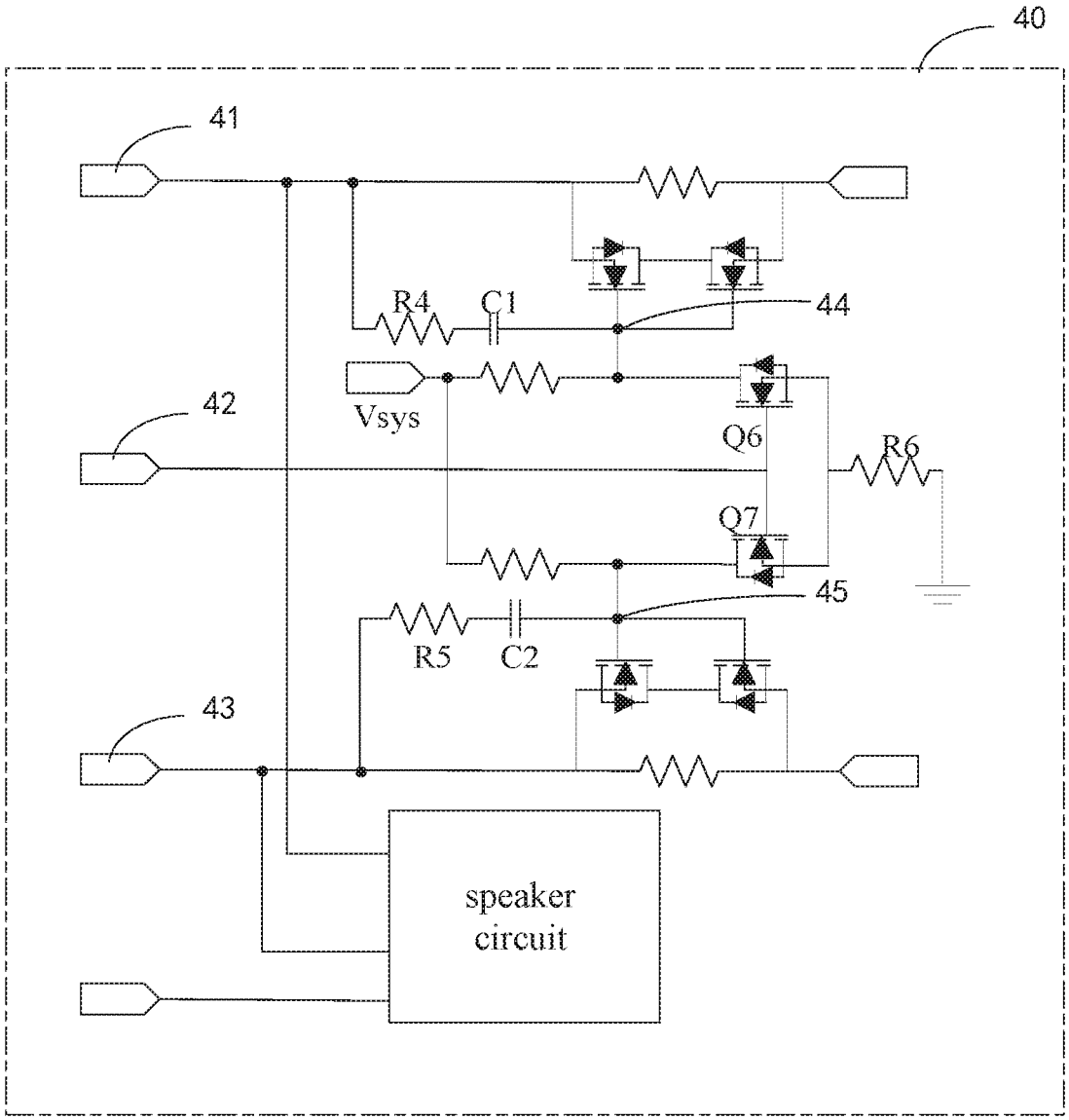
FIG. 4 is a circuit illustration of a playing device in accordance with another embodiment in the present disclosure.

FIG. 4 is a circuit illustration of a playing device 40 in accordance with another embodiment in the present disclosure.

The difference from the above-mentioned embodiment is described following. A first switching circuit may further include a first capacitor C1 and a third resistor R4. One end of the third resistor R4 may be connected to a left channel output terminal 41 of a sound source output terminal. The other end of the third resistor R4 may be connected to one end of the first capacitor C1. The other end of the first capacitor C1 may be connected to a control circuit. A second switching circuit may further include a second capacitor C2 and a fourth resistor R5. One end of the fourth resistor R5 may be connected to a right channel output terminal 43 of the sound source output terminal. The other end of the fourth resistor R5 may be connected to one end of the second capacitor C2. The other end of the second capacitor C2 may be connected to the control circuit.

A resistance value of the third resistor R4 and a resistance value of the fourth resistor R5 may be in a range of 3K to 10K ohm, and which may be designed according to specific conditions.

The control circuit may further include multiple switching devices. The switching device may include a metal oxide semiconductor (MOS) transistor and a bipolar junction transistor. In one of the embodiments, the control circuit may include a first switching device Q6 and a second switching device Q7. A control terminal of the first switching device Q6 and a control terminal of the second switching device Q7 may be connected to a second enable signal output terminal 42. An input terminal of the first switching device Q6 may be respectively connected to the first capacitor C1 and a control terminal 44 of the first switching circuit. An input terminal of the second switching device Q7 may be respectively connected to the second capacitor C2 and a control terminal 45 of the second switching circuit. An output terminal of the first switching device Q6 and an output terminal of the second switching device Q7 may be respectively grounded.

In another embodiment, the control circuit may further include a fifth resistor R6. One end of the fifth resistor R6 may be connected to the output terminal of the first switching device Q6 and the output terminal of the second switching device Q7. The other end of the fifth resistor R6 may be grounded.

The specific working principle of this embodiment is the same as the above-mentioned embodiment, except that the first capacitor C1 and the second capacitor C2 may prevent the power supply Vsys from being loaded on a sound source signal line. The third resistor R4 and the third resistor R5 may ensure that, when the first switching device Q6 and the second switching device Q7 is turned on, the sound source signal may be not directly transmitted to the ground.

Different from the related art, the present disclosure provides the playing device including the headphone interface circuit and the speaker circuit; wherein the signal input terminal of the headphone interface circuit and the signal input terminal of the speaker circuit are directly connected to the sound source output terminal of the playing device; the signal input terminal of the speaker circuit is further connected to a first enable signal output terminal of the playing device; and when the first enable signal output terminal outputs the matched enable signal, the sound source signal output from the sound source output terminal is played by the speaker circuit; the signal input terminal of the headphone interface circuit is further connected to the second enable signal output terminal of the playing device; and when the headphone is inserted and the second enable signal output terminal outputs the matched enable signal, the sound source signal output from the sound source output terminal is played by the headphone. Therefore, the function that the speaker and the external audio device of the playing device can be driven simultaneously, may be realized, and the user experience may be improved.

Different from the above-mentioned embodiment, corresponding resistance and capacitance are added in this embodiment, which may improve an anti-interference ability of the playing device, and the user experience may be better.

Figure 5:
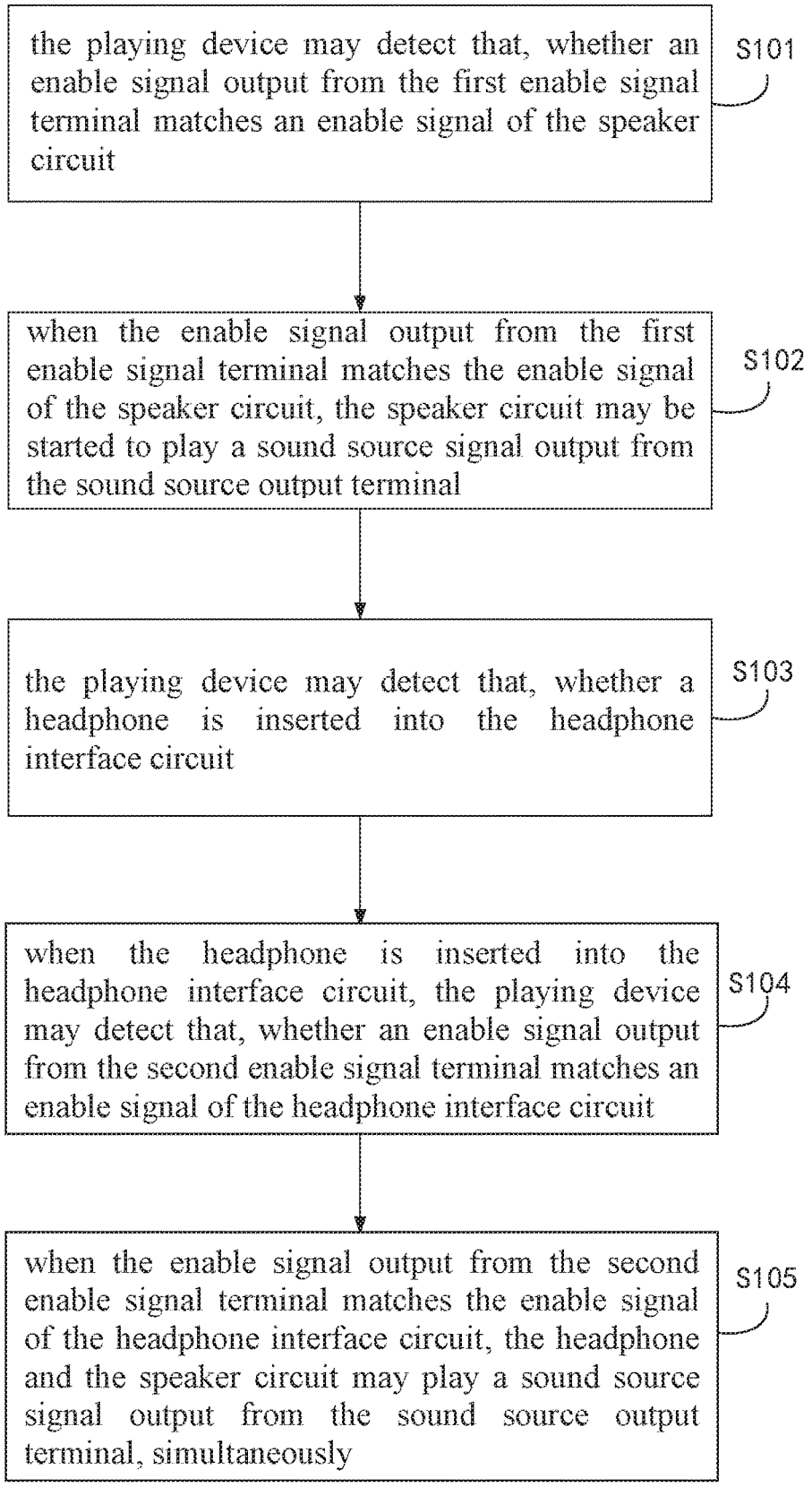
FIG. 5 is a flow chart of a playing method based on a playing device in accordance with an embodiment in the present disclosure.

FIG. 5 is a flow chart of a playing method based on a playing device in accordance with an embodiment in the present disclosure.

In this embodiment, the playing device may include a headphone interface circuit and a speaker circuit. A signal input terminal of the headphone interface circuit and a signal input terminal of the speaker circuit may be directly connected to a sound source output terminal of the playing device. The signal input terminal of the speaker circuit may be further connected to a first enable signal output terminal of the playing device. The signal input terminal of the headphone interface circuit may be further connected to a second enable signal output terminal of the playing device. The playing method may include operations in the following blocks.

Block S101, the playing device may detect that, whether an enable signal output from the first enable signal terminal matches an enable signal of the speaker circuit.

The playing device may include a mobile phone, a tablet computer, and so on, and it is not specifically limited here.

The playing device may receive operation instructions from a user, and may output an enable signal corresponding to the operation instructions from the user, by the first enable signal terminal. The enable signal may be high level or low level, and it may be determined according to an actual design.

The playing device may detect the enable signal output from the first enable signal end, and may determine whether the detected enable signal matches a turn-on signal of the speaker circuit.

Block S102, when the enable signal output from the first enable signal terminal matches the enable signal of the speaker circuit, the speaker circuit may be started to play a sound source signal output from the sound source output terminal.

In this embodiment, when the enable signal output from the first enable signal terminal matches the enable signal of the speaker circuit the speaker circuit may be started to play a sound source signal output from the sound source output terminal.

In an embodiment in a case of that the turn-on signal of the speaker circuit is high level, when the detected enable signal is high level, the speaker circuit may be started to play a sound source signal output from the sound source output terminal.

Block S103, the playing device may detect that, whether a headphone is inserted into the headphone interface circuit.

In this embodiment, the playing device may detect that, whether a headphone is inserted into the headphone interface circuit. When a headphone is inserted into the headphone interface circuit, the playing device may receive a corresponding response signal, and may determine whether a headphone is inserted, according to the response signal.

S104, when the headphone is inserted into the headphone interface circuit, the playing device may detect that, whether an enable signal output from the second enable signal terminal matches an enable signal of the headphone interface circuit.

In this embodiment, when the headphone is inserted into the headphone interface circuit, the playing device may further detect that, whether an enable signal output from the second enable signal terminal matches an enable signal of the headphone interface circuit.

In an embodiment, the playing device may receive operation instructions from a user, and may output an enable signal corresponding to the operation instructions from the user, by the second enable signal terminal. The enable signal may be high level or low level, and it may be determined according to an actual design.

The playing device may detect the enable signal output from the second enable signal terminal, and may determine whether the detected enable signal matches a turn-on signal of the headphone interface circuit.

Block S105, when the enable signal output from the second enable signal terminal matches the enable signal of the headphone interface circuit, the headphone and the speaker circuit may play a sound source signal output from the sound source output terminal, simultaneously.

In this embodiment, when the enable signal output from the second enable signal terminal matches the enable signal of the headphone interface circuit, the headphone may play a sound source signal.

In an embodiment, when both the headphone interface circuit and the speaker circuit are turned on, the playing device may play the sound source signal output from the sound source output terminal by the headphone and the speaker circuit, simultaneously.

Different from the related art, the present disclosure provides the playing device including the headphone interface circuit, and the speaker circuit; wherein the signal input terminal of the headphone interface circuit and the signal input terminal of the speaker circuit are directly connected to the sound source output terminal of the playing device; the signal input terminal of the speaker circuit is further connected to a first enable signal output terminal of the playing device; and when the first enable signal output terminal outputs the matched enable signal, the sound source signal output from the sound source output terminal is played by the speaker circuit; the signal input terminal of the headphone interface circuit is further connected to the second enable signal output terminal of the playing device; and when the headphone is inserted and the second enable signal output terminal outputs the matched enable signal, the sound source signal output from the sound source output terminal is played by the headphone. Therefore, the function that the speaker and the external audio device of the playing device can be driven simultaneously, may be realized, and the user experience may be improved.

It should be understood that, those skilled in the art may make equivalent substitutions or changes to the embodiments in the present disclosure, and all such changes or substitutions belong to the scope of the appended claims.

What is claimed is:

1. A playing device, comprising a headphone interface circuit and a speaker circuit;

wherein a signal input terminal of the headphone interface circuit and a signal input terminal of the speaker circuit are directly connected to a sound source output terminal of the playing device;

the speaker circuit is further connected to a first enable signal output terminal of the playing device; and when the first enable signal output terminal outputs a matched enable signal, a sound source signal output from the sound source output terminal is played by the speaker circuit;

the headphone interface circuit is further connected to a second enable signal output terminal of the playing device; and when a headphone is inserted and the second enable signal output terminal outputs a matched enable signal, a sound source signal output from the sound source output terminal is played by the headphone; the headphone interface circuit comprises a first switching circuit, a second switching circuit, and a control circuit; an input terminal of the first switching circuit is connected to a left channel output terminal of the sound source output terminal; and an input terminal of the second switching circuit is connected to a right channel output terminal of the sound source output terminal; an output terminal of the first switching circuit is connected to a left channel signal output terminal of the headphone interface circuit; an output terminal of the second switching circuit is connected to a right channel signal output terminal of the headphone interface circuit; a control terminal of the first switching circuit and a control terminal of the second switching circuit are connected to the control circuit; the control circuit is further connected to the second enable signal output terminal; and when a headphone is inserted and the second enable signal output terminal outputs a matched enable signal, the control circuit controls the first switching circuit and the second switching circuit to turned on, and a sound source signal output from the sound source output terminal is played by the headphone;

the first switching circuit comprises one switching device or a plurality of switching devices connected in series;

the second switching circuit comprises one switching device or a plurality of switching devices connected in series; the headphone interface circuit further comprises a first resistor and a second resistor; the first resistor is connected in parallel with the first switching circuit; and the second resistor is connected in parallel with the second switching circuit.

2. The playing device claimed as in claim 1, wherein the first switching circuit further comprises a first capacitor and a third resistor; one end of the third resistor is connected to the left channel output terminal of the sound source output terminal; the other end of the third resistor is connected to one end of the first capacitor; and the other end of the first capacitor is connected to the control circuit;

the second switching circuit further comprises a second capacitor and a fourth resistor; one end of the fourth resistor is connected to the right channel output terminal of the sound source output terminal; the other end of the fourth resistor is connected to one end of the second capacitor; and the other end of the second capacitor is connected to the control circuit.

3. The playing device claimed as in claim 1, wherein the speaker circuit further comprises a power amplifier; an input terminal of the power amplifier is connected to the sound source output terminal and the first enable signal output terminal; and an output terminal of the power amplifier is connected to a speaker in the speaker circuit;

a resistance value of the first resistor and a resistance value of the second resistor are determined by the following formula (1);

$$R = \left(\frac{V_{rms1}}{V_{rms2}} - 1\right) * R_2 \quad (1)$$

wherein, R is the resistance value of the first resistor or the resistance value of the second resistor, and $V_{rms1}$ is an effective voltage value of the sound source signal received by the power amplifier;

$V_{rms2}$ is an effective voltage value of the sound source signal through the transmission branch formed by the respective first resistor or second resistor, received by a headphone; and $R_2$ is an impedance value of the headphone.

4. The playing device claimed as in claim 2, wherein a resistance value of the third resistor and a resistance value of the fourth resistor are in a range of 3K to 10K ohm.

5. The playing device claimed as in claim 2, wherein the control circuit comprises a first switching device and a second switching device; and a control terminal of the first switching device and a control terminal of the second switching device is connected to the second enable signal output terminal;

an input terminal of the first switching device is respectively connected to the first capacitor and a control terminal of the first switching circuit; an input terminal of the second switching device is respectively connected to the second capacitor and a control terminal of the second switch; and an output terminal of the first switching device and an output terminal of the second switching device are respectively grounded.

6. The playing device claimed as in claim 5, wherein the control circuit further comprises a fifth resistor; one end of the fifth resistor is connected to the output terminal of the first switching device and the output terminal of the second switching device; and the other end of the fifth resistor is grounded.

7. A playing method based on a playing device, wherein the playing device comprises a headphone interface circuit and a speaker circuit; a signal input terminal of the headphone interface circuit and a signal input terminal of the speaker circuit are directly connected to a sound source output terminal of the playing device; the speaker circuit is further connected to a first enable signal output terminal of the playing device; and the headphone interface circuit is further connected to a second enable signal output terminal of the playing device;

the playing method comprises:

detecting by the playing device, whether an enable signal output from the first enable signal terminal matches an enable signal of the speaker circuit;

when the enable signal output from the first enable signal terminal matches the enable signal of the speaker circuit, starting the speaker circuit to play a sound source signal output from the sound source output terminal;

detecting whether a headphone is inserted into the headphone interface circuit;

when the headphone is inserted into the headphone interface circuit, detecting whether an enable signal output from the second enable signal terminal matches an enable signal of the headphone interface circuit;

when the enable signal output from the second enable signal terminal matches the enable signal of the headphone interface circuit, playing a sound source signal output from the sound source output terminal, by the headphone and the speaker circuit simultaneously, wherein, the headphone interface circuit comprises a first switching circuit, a second switching circuit, and a control circuit;

an input terminal of the first switching circuit is connected to a left channel output terminal of the sound source output terminal; and an input terminal of the second switching circuit is connected to a right channel output terminal of the sound source output terminal; an output terminal of the first switching circuit is connected to a left channel signal output terminal of the headphone interface circuit; an output terminal of the second switching circuit is connected to a right channel signal output terminal of the headphone interface circuit;

a control terminal of the first switching circuit and a control terminal of the second switching circuit are connected to the control circuit; the control circuit is further connected to the second enable signal output terminal; and when a headphone is inserted and the second enable signal output terminal outputs a matched enable signal, the control circuit controls the first switching circuit and the second switching circuit to turned on, and a sound source signal output from the sound source output terminal is played by the headphone, wherein, the first switching circuit comprises one switching device or a plurality of switching devices connected in series; and the second switching circuit comprises one switching device or a plurality of switching devices connected in series, wherein, the headphone interface circuit further comprises a first resistor and a second resistor, the first resistor is connected in parallel with the first switch circuit, and the second resistor is connected in parallel with the second switch circuit.

8. The method claimed as in claim 7, wherein the first switching circuit further comprises a first capacitor and a third resistor; one end of the third resistor is connected to the left channel output terminal of the sound source output terminal; the other end of the third resistor is connected to one end of the first capacitor; and the other end of the first capacitor is connected to the control circuit;

the second switching circuit further comprises a second capacitor and a fourth resistor; one end of the fourth resistor is connected to the right channel output terminal of the sound source output terminal; the other end of the fourth resistor is connected to one end of the second capacitor; and the other end of the second capacitor is connected to the control circuit.

* * * * *